US007540389B2

(12) United States Patent
Fontana

(10) Patent No.: US 7,540,389 B2
(45) Date of Patent: Jun. 2, 2009

(54) BOTTLE FOR FLUID PRODUCTS, PARTICULARLY PHARMACEUTICAL, MEDICINAL AND COSMETIC PRODUCTS

(75) Inventor: Antonio Fontana, Carpi (IT)

(73) Assignee: Lameplast S.p.A., Modena (IT)

( * ) Notice: Subject to any disclaimer, the term of this patent is extended or adjusted under 35 U.S.C. 154(b) by 351 days.

(21) Appl. No.: 10/569,081

(22) PCT Filed: Sep. 27, 2004

(86) PCT No.: PCT/EP2004/010819

§ 371 (c)(1),
(2), (4) Date: Feb. 21, 2006

(87) PCT Pub. No.: WO2005/040000

PCT Pub. Date: May 6, 2005

(65) Prior Publication Data

US 2007/0007227 A1 Jan. 11, 2007

(30) Foreign Application Priority Data

Oct. 21, 2003 (IT) ..... MOO3A0283

(51) Int. Cl.
*B65D 1/02* (2006.01)

(52) U.S. Cl. ..... 215/48; 215/250; 215/47; 215/50; 215/330; 220/23.4

(58) Field of Classification Search ..... 215/48, 215/250, 50, 355, 47, 330; 220/23.4
See application file for complete search history.

(56) References Cited

U.S. PATENT DOCUMENTS 2,771,218 A * 11/1956 Henderson ..... 222/83
3,083,858 A * 4/1963 Biedenstein ..... 220/265
3,917,120 A * 11/1975 Larenz et al. ..... 222/129
3,994,412 A * 11/1976 Difiglio ..... 220/266
4,134,511 A * 1/1979 Deussen ..... 215/48
4,512,475 A * 4/1985 Federighi ..... 206/484
4,519,514 A * 5/1985 Agbay et al. ..... 215/225
4,790,453 A * 12/1988 Fontana et al. ..... 222/83
4,867,326 A * 9/1989 O'Meara ..... 215/250
4,951,822 A * 8/1990 Fontana et al. ..... 206/530

(Continued)

FOREIGN PATENT DOCUMENTS

CH 676 109 A 12/1990

(Continued)

*Primary Examiner*—Anthony D Stashick
*Assistant Examiner*—Christopher B McKinley
(74) *Attorney, Agent, or Firm*—Browdy and Neimark, P.L.L.C.

(57) ABSTRACT

A bottle for fluid products, particularly pharmaceutical, medicinal and cosmetic products, comprising a body for containing a fluid product, particularly a pharmaceutical, medicinal or cosmetic product, a mouth for dispensing the product, which is formed at one end of the containment body, a closure element associated detachably with the dispensing mouth, a cap associated with the end of the containment body, an element for removing the closure element that is formed inside the cap, at least one grip tab that protrudes from the outer lateral surface of the containment body, and at least one sealing tab, which is interposed between the cap and the grip tab and is associated, so that it can be removed by tearing, with at least one among the containment body, the grip tab and the cap, at respective first weakened regions.

21 Claims, 3 Drawing Sheets

U.S. PATENT DOCUMENTS 5,042,690 A * 8/1991 O'Meara ..... 222/83
5,052,589 A * 10/1991 O'Meara ..... 222/83
5,184,742 A * 2/1993 DeCaprio et al. ..... 215/356
5,203,838 A * 4/1993 Schneider ..... 215/253
5,228,593 A * 7/1993 O'Meara ..... 222/41
5,577,636 A * 11/1996 Fukuoka et al. ..... 222/94
5,586,672 A * 12/1996 Schneider et al. ..... 215/250
5,590,798 A * 1/1997 O'Connell ..... 215/48
5,908,124 A * 6/1999 Klauke et al. ..... 215/48
6,138,849 A * 10/2000 Roemer et al. ..... 215/48
6,173,852 B1 * 1/2001 Browne ..... 215/247
6,234,333 B1 * 5/2001 Federighi et al. ..... 215/48
6,382,438 B1 * 5/2002 Schneider et al. ..... 215/48
6,409,032 B1 * 6/2002 Bekkers et al. ..... 215/48
D460,175 S * 7/2002 Louviere ..... D24/115
D471,628 S * 3/2003 Louviere ..... D24/115
6,626,308 B2 * 9/2003 Weiler ..... 215/48
6,827,227 B2 * 12/2004 Fontana ..... 215/48
6,874,665 B2 * 4/2005 Doherty et al. ..... 222/541.5
6,991,140 B2 * 1/2006 Bourque et al. ..... 222/541.9
7,188,750 B2 * 3/2007 Vogel et al. ..... 222/83
2002/0100741 A1 * 8/2002 Weiler ..... 215/48
2003/0155356 A1 * 8/2003 Fontana ..... 220/23.4

FOREIGN PATENT DOCUMENTS

GB 2 039 267 A 8/1980

* cited by examiner

BOTTLE FOR FLUID PRODUCTS, PARTICULARLY PHARMACEUTICAL, MEDICINAL AND COSMETIC PRODUCTS

TECHNICAL FIELD

The present invention relates to a bottle for fluid products, particularly pharmaceutical, medicinal and cosmetic products.

BACKGROUND ART

Plastic bottles are known and are used in pharmaceutical and cosmetic industries to package one or more doses of fluid, liquid or pasty products and are substantially constituted by a product containment body that is extended at one end by a neck, at the top of which there is a mouth for dispensing the product; the dispensing mouth is closed by a tearable membrane.

The end of the containment body that lies opposite the neck is open, in order to allow, during bottle packaging, the introduction of the product in the containment body, after which the end is closed for example by welding.

A cap is fitted on the neck, and a membrane piercing member protrudes from the top of the cap toward the inside of the cap.

A retention ring is formed on the inner lateral surface of the cap and in the closed configuration for packaging the bottle is engaged by snap action in a corresponding annular groove formed on the lateral outer surface of the neck, so as to retain the piercing member at a higher level than the membrane that closes the dispensing mouth.

Moreover, the containment body is provided with two grip tabs, which protrude from its outer lateral surface so that they are diametrically mutually opposite.

Conventional bottles can be produced as individual units or can be interconnected in series (packs); in this last case, the grip tabs of the containment bodies of two successive bottles are mutually temporarily joined along prescoring lines.

At the time of use, the cap is fitted further onto the neck of the containment body until the retaining ring disengages from the corresponding groove and the piercing member tears the membrane, opening the dispensing mouth, after which the cap is removed from the neck in order to allow dispensing of the product.

These known bottles are not free from drawbacks, including the fact that they do not indicate clearly and in an immediately detectable manner whether they have been tampered with and/or already opened a first time, even unintentionally, and they do not ensure the integrity and sterility of the product packaged therein.

The bottles, handled or stored in containers (drawers, cabinets, makeup bags, et cetera), may in fact be subjected to impacts that push their cap onto the neck until the piercing member tears the membrane before the product is actually used, since the obstacle provided by the coupling between the retention ring and the corresponding annular groove is often insufficient to contrast such impacts.

DISCLOSURE OF THE INVENTION

The aim of the present invention is to eliminate the drawbacks noted above of known bottles, by providing a bottle for fluid products, particularly pharmaceutical, medicinal and cosmetic products, that allows to indicate clearly and in an immediately detectable manner any tampering and/or previous first opening, even if performed unintentionally, and ensures the integrity and sterility of the product packaged therein.

Within this aim, an object of the present invention is to provide a bottle that is simple, relatively easy to provide in practice, safe in use, effective in operation, and has a relatively low cost.

This aim and this and other objects that will become better apparent hereinafter are achieved by the present bottle for fluid products, particularly pharmaceutical, medicinal and cosmetic products, characterized in that it comprises a body for containing a fluid product, particularly a pharmaceutical, medicinal or cosmetic product, a mouth for dispensing said product that is formed at one end of said containment body, a closure element associated detachably with said dispensing mouth, a cap associated with said end of the containment body, an element for removing said closure element that is formed inside said cap, at least one grip tab that protrudes from the outer lateral surface of said containment body, and at least one sealing tab, which is interposed between said cap and said grip tab and is associated, so that it can be removed by tearing, with at least one among said containment body, said grip tab and said cap, at respective first weakened regions.

BRIEF DESCRIPTION OF THE DRAWINGS

Further characteristics and advantages of the present invention will become better apparent from the following detailed description of two preferred but not exclusive embodiments of a bottle for fluid products, particularly pharmaceutical, medicinal and cosmetic products, illustrated by way of non-limiting example in the accompanying drawings, wherein.

WAYS OF CARRYING OUT THE INVENTION

Figure 1:
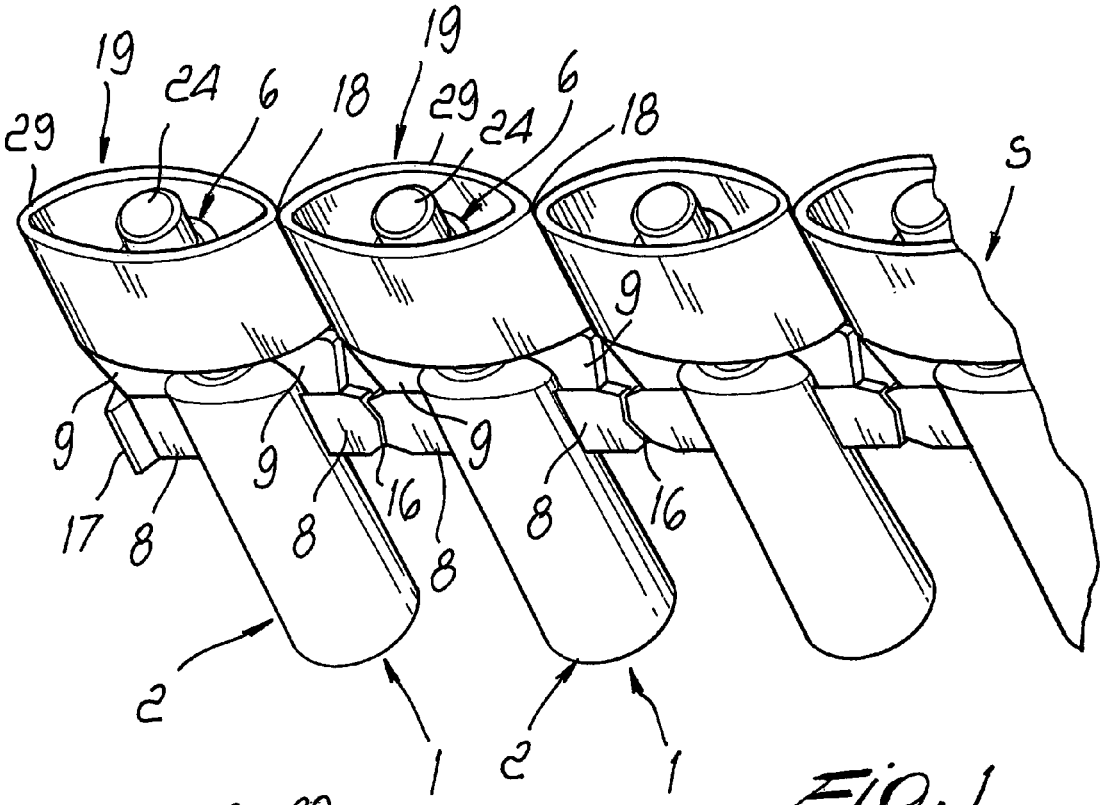
FIG. 1 is a schematic perspective view of a plurality of bottles according to the invention, in a first embodiment, which are mutually interconnected in series.
Figure 2:
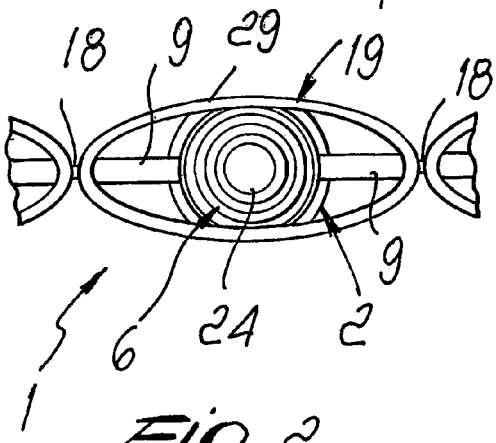
FIG. 2 is a schematic top plan view of one of the bottles of FIG. 1.
Figure 3:
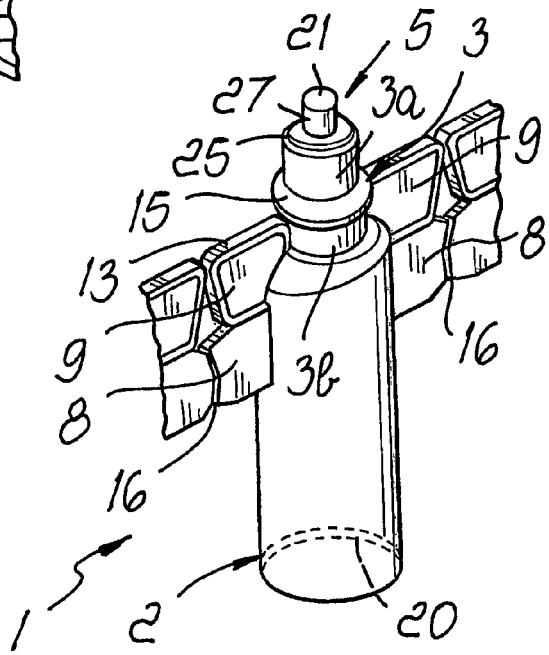
FIG. 3 is a schematic perspective view of the containment body of one of the bottles of FIG. 1.
Figure 4:
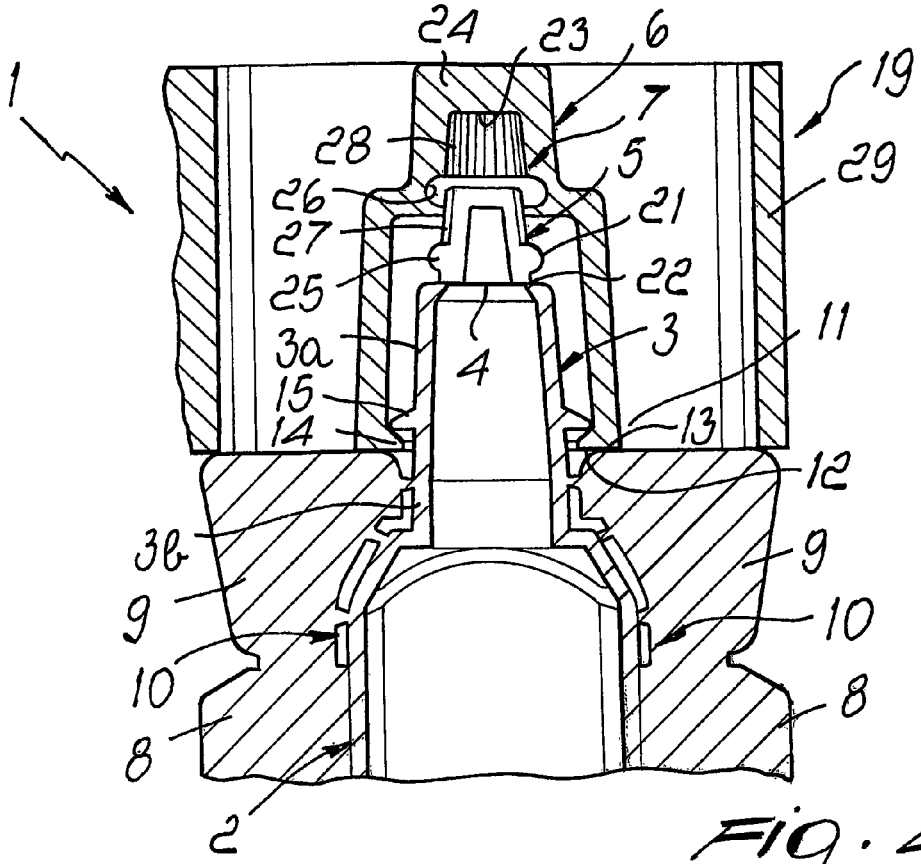
FIG. 4 is a schematic enlarged-scale sectional view of a detail of a bottle of FIG. 1.

With reference to the figures, the reference numeral 1 generally designates a bottle for fluid products, particularly pharmaceutical, medicinal and cosmetic products.

The bottle 1 can be obtained for example by molding plastic material.

The bottle 1 comprises a product containment body 2, which is extended, at one end, by means of a neck 3, at the top of which there is a mouth 4 for dispensing the product.

A closure element 5 is detachably associated with the mouth 4; a cap 6 is fitted at least partially over the neck 3, and an element 7 for removing the closure element 5 is formed inside the cap 6.

At least one and preferably two grip tabs 8 protrude from the outer lateral surface of the body 2 so that they are mutually diametrically opposite, and at least one and preferably two sealing tabs 9 are interposed between the grip tabs 8 and the cap 6 and are associated, so that they can be removed by tearing, with the body 2, proximate to the neck 3, and/or with the grip tabs 8 and/or with the base of the cap 6, at respective first weakened regions 10.

The sealing tabs 9 are superimposed and aligned with the grip tabs 8, with which they are substantially co-planar.

The neck 3 comprises an end portion 3*a,* on which the cap 6 is fitted in the closed packaging configuration of the bottle 1, and a base portion 3*b,* which is interposed between the body 2 and the end portion 3*a*, at which there is at least one portion of the sealing tabs 9.

Means 11 for temporarily retaining the cap 6 in a configuration in which there is no interference between the removal element 7 and the closure element 5 when the bottle 1 is in the closed packaging configuration are provided; in this configuration, said means are suitable to hinder the further intentional and accidental approach and/or spacing of the cap 6 and of the body 2, preserving the integrity of the closure element 5 and the seal of the mouth 4.

The temporary retention means 11 can comprise, for example, an abutment surface 12, which is formed at the base of the cap 6 and is suitable to rest on a corresponding abutment surface 13 formed on the upper edge of the sealing tabs 9.

Moreover, the temporary retention means 11 may comprise, for example, two annular retention rings 14 and 15, which are suitable to engage each other and protrude respectively at the base of the inner lateral surface of the cap 6 and from the outer lateral surface of the body 2, particularly of the neck 3.

The bottle 1 can be produced as an individual unit or can be interconnected in series S (packs) to other identical bottles 1; in this last case, the grip tabs 8 of each bottle 1 that is intermediate within the series S are associated, along second weakened regions 16, with the grip tabs 8 of the bodies 2 of the other two bottles 1 arranged adjacent thereto, while the grip tabs 8 of the end bottles 1 of the series S that are external to the series S end with an enlarged portion 17.

Conveniently, again if the bottle 1 is produced in series S, the cap 6 can be associated, along third weakened regions 18, with the caps 6 of the bottles 1 that are adjacent thereto.

Moreover, the cap 6 can be provided with an actuation tool 19 that is rigidly coupled thereto; in this case, the third weakened regions 18 are formed between the actuation tools 19 of the caps 6 of two adjacent bottles 1.

At the end of the body 2 that lies opposite the neck 3 there is an opening 20 through which the product is introduced in the body 2 during the packaging of the bottle 1; once filling has occurred, the opening 20 is closed for example by welding its lips.

In the first embodiment of the bottle 1, shown in FIGS. 1 to 4, the closure element 5 is constituted by a plug 21, which is associated, along fourth weakened regions 22, with the perimetric rim of the mouth 4, while the removal element 7 is constituted by a complementary receptacle 23 for containing the plug 21 formed at the top 24 of the cap 6; means for the mutual coupling of the plug 21 and the receptacle 23 are provided.

The receptacle 23 has a profile that is identical to the profile of the plug 21.

The means for mutually coupling the plug 21 and the receptacle 23 can comprise, for example, a toroidal ring 25, which protrudes from the outer lateral surface of the plug 21, and a corresponding annular groove 26, which is formed at the receptacle 23, the ring and the groove preventing axial sliding between the plug 21 and the receptacle 23 once the former has engaged within the latter.

Moreover, the means for mutually coupling the plug 21 and the receptacle 23 can comprise a plurality of knurlings 27, which are formed longitudinally on the outer lateral surface of the plug 21 and are suitable to mate with corresponding knurlings 28 formed longitudinally on the inner lateral surface of the receptacle 23, in order to prevent relative rotation between the plug 21 and the receptacle 23 once the former has engaged within the latter.

The actuation tool 19 is constituted by a band 29, which is wrapped substantially like a ring around the cap 6, is rigidly coupled to its base, and forms a cambered grip.

Figure 5:
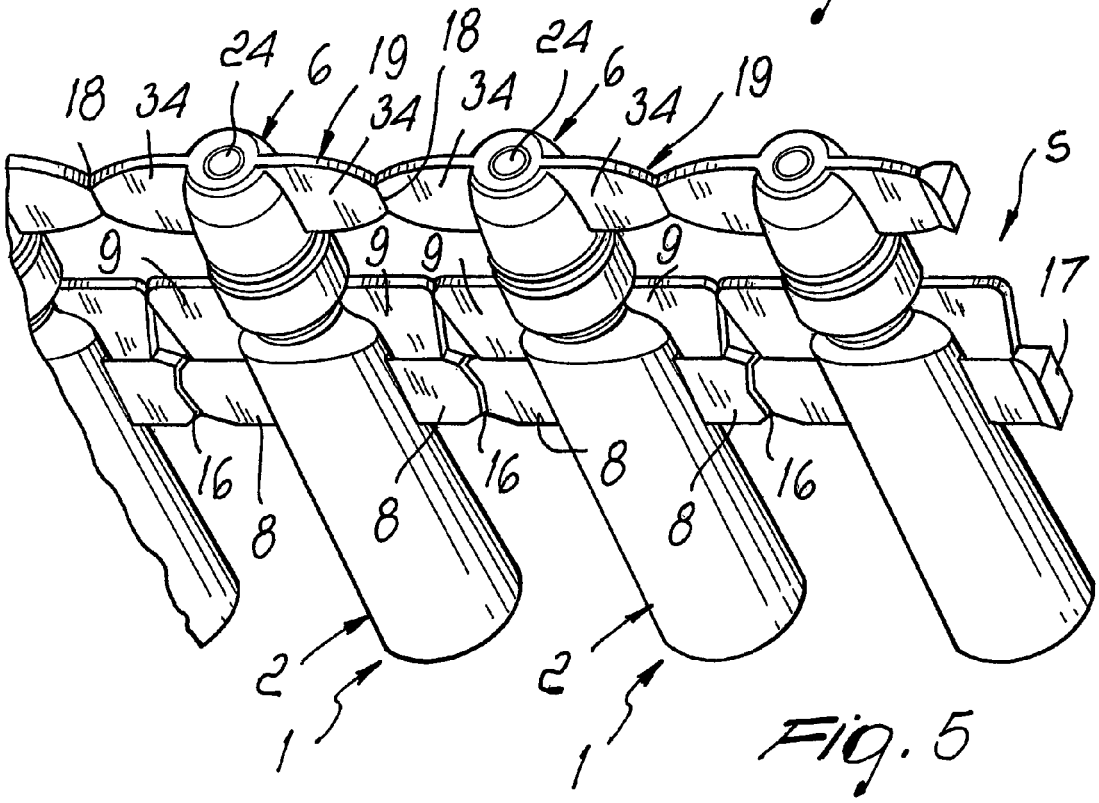
FIG. 5 is a schematic perspective view of a plurality of bottles according to the invention in a second embodiment, mutually interconnected in series.
Figure 6:
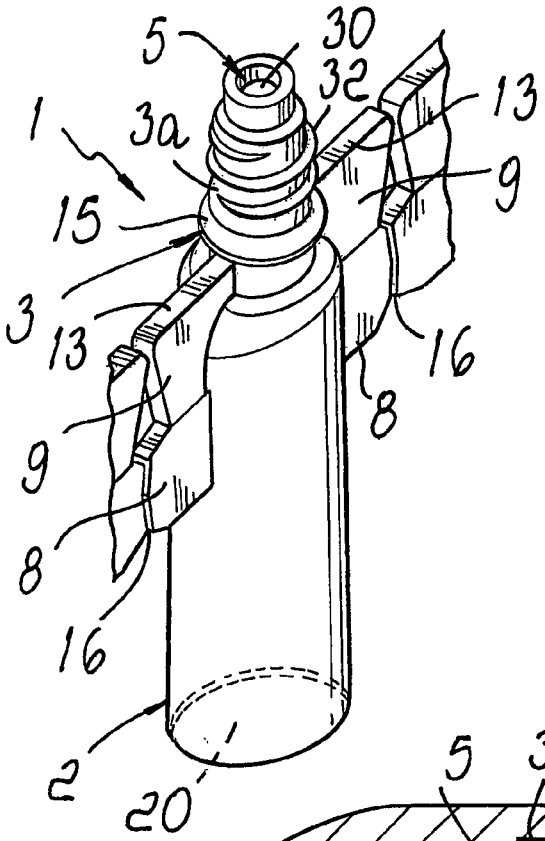
FIG. 6 is a schematic perspective view of the containment body of one of the bottles of FIG. 5.
Figure 7:
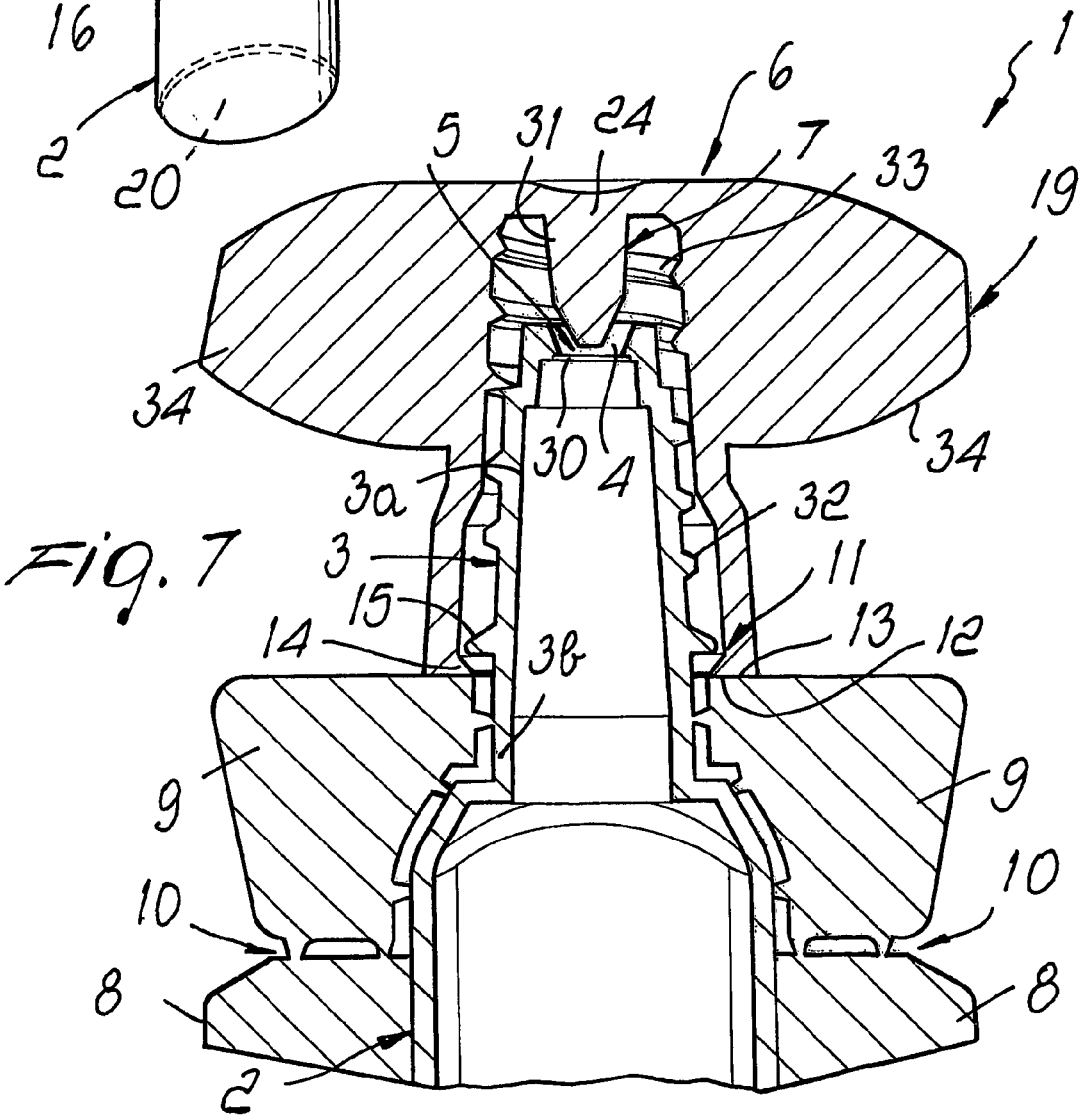
FIG. 7 is a schematic enlarged-scale sectional view of a detail of a bottle of FIG. 5.

In the second embodiment of the bottle 1, shown in FIGS. 5 to 7, the closure element 5 is constituted by a tearable membrane 30, which is rigidly coupled to the perimetric rim of the mouth 4, while the removal element 7 is constituted by a piercing member 31 that protrudes from the top 24 of the cap 6 inside it.

The membrane 30 can be constituted, for example, by a disk made of a material that is formed monolithically with respect to the body 2 during the molding of said body.

There are also means for fixing the cap 6 to the body 2, which are for example of the threaded type and comprise a screw 32 formed on the outer lateral surface of the body 2, particularly of the neck 3, and a corresponding female thread 33 formed on the inner lateral surface of the cap 6.

Conveniently, the mouth 4 is shaped like a frustum that diverges from the inside toward the outside of the body 2.

The actuation tool 19 is constituted by two actuation tabs 34, which are mutually diametrically opposite and protrude from the outer lateral surface of the cap 6.

Advantageously, the actuation tabs 34 are aligned with the sealing tabs 9 and with the grip tabs 8 and are substantially co-planar therewith.

The first weakened regions 10, the second weakened regions 16, the third weakened regions 18 and the fourth weakened regions 22 can be constituted for example by prescoring lines, by tearable bridges, by reduced transverse cross-sections, or the like.

The operation of the invention is as follows.

The bottle 1 assumes a closed packaging configuration, in which the opening 20 of the body 2, filled with product, is closed, the mouth 4 is closed by the closure element 5, the cap 6 is fitted on the end portion 3*a* of the neck 3 up to a level that avoids interference between the removal element 7 and the closure element 5, and the sealing tabs 9 are associated with the body 2 (base portion 3*b* of the neck 3) and/or with the grip tabs 8 and/or with the cap 6.

The bottle 1 can be produced and packaged as an individual unit or in a series S.

At the time of use, after possibly separating the bottle 1 from the series S, it is first of all necessary to remove the sealing tabs 9 by tearing, so as to allow to fit at least partially the cap 6 on the base portion 3*b* of the neck 3; by doing so, the removal element 7 interferes with the closure element 5, opening the mouth 4.

Finally, in order to dispense the product it is necessary to remove the cap 6, clearing the open mouth 4; when use is over, it is possible to close the body 2 by means of the cap 6.

At the time of use of the bottle 1 in its first embodiment, the cap 6 is fitted onto the base portion 3*b* by applying thereto a thrusting action toward the body 2; during the axial sliding imparted to the cap 6, the plug 21 is inserted by interlocking in the receptacle 23 and is thus rigidly coupled to the cap 6.

By gripping the actuation tool 19 and imparting, by means of said tool, a rotation to the cap 6 and therefore also to the plug 21 that is rigidly coupled thereto, the fourth weakened regions 22 are broken: the plug 21 disengages from the mouth 4 and remains rigidly coupled to the cap 6.

At the time of use of the bottle 1 in its second embodiment, the cap 6 is fitted onto the base portion 3*b* by applying thereto, by means of the actuation tool 19, a rotation as a consequence of which the female thread 33 is screwed onto the screw 32; as the cap 6 is gradually screwed onto the neck 3, the piercing member 31 tears the membrane 30, opening the mouth 4.

In practice, it has been found that the described invention achieves the intended aim and object.

The presence or absence of the sealing tabs in fact provides a clear indication, and allows immediate detection, of the integrity or prior opening of the bottle according to the invention.

Moreover, the sealing tabs prevent, by constituting a hindrance, the fitting of the cap onto the base portion of the neck of the containment body, retaining the removal element in the configuration in which there is no interference with the closure element, ensuring the seal of the dispensing mouth and therefore the integrity and sterility of the product packaged in the bottle.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the appended claims.

The disclosures in Italian Patent Application No. MO2003A000283 from which this application claims priority are incorporated herein by reference.

The invention claimed is:

1. A bottle for fluid products, particularly pharmaceutical, medicinal and cosmetic products, comprising:

a body for containing a fluid product, particularly a pharmaceutical, medicinal or cosmetic product, a mouth for dispensing said product that is formed at one end of said containment body, a closure element associated detachably with said dispensing mouth, a cap associated with said end of the containment body, an element for removing said closure element that is formed inside said cap, at least one grip tab that protrudes from the outer lateral surface of said containment body, and at least one sealing tab, which is interposed between said cap and said grip tab and is associated, so that it can be removed by tearing, with at least one among said containment body, said grip tab and said cap, at respective first weakened regions, wherein in a closed configuration of said bottle, said at least one sealing tab is in contact with both said cap and said grip tabs, said grip tabs and said sealing tabs are formed so as to be substantially mutually co-planar, and said end of the containment body continues with a neck, at the top of which said dispensing mouth is provided, said neck comprising an end portion, on which said cap is fitted, in the closed packaging configuration of the bottle, and a base portion, which is interposed between said containment body and said end portion, at which there is at least one portion of said sealing tabs.

2. The bottle of claim 1, comprising retention means for temporarily retaining said cap in the configuration in which there is no interference between said removal element and said closure element, said means being adapted to hinder the further approach and/or spacing of said cap and of said containment body.

3. The bottle of claim 2, wherein said retention means comprise an abutment surface, which is formed at the base of said cap and is adapted to rest on a corresponding abutment surface formed at the top of said sealing tabs.

4. The bottle of claim 2, wherein said retention means comprise at least one pair of retention teeth, which protrude respectively from the inner lateral surface of said cap and from the outer lateral surface of said containment body and are adapted to engage each other.

5. The bottle of claim 1, comprising two of said grip tabs, which are formed so as to be mutually diametrically opposite, and two of said sealing tabs, which are formed so as to be mutually diametrically opposite.

6. The bottle of claim 1, wherein said grip tabs are arranged, along second weakened regions, with the grip tabs of the containment bodies of other said bottles that are arranged adjacent thereto in series.

7. The bottle of claim 1, wherein said cap is associated, along third weakened regions, with the cap of other said bottles that are arranged adjacent thereto in series.

8. The bottle of claim 1, comprising an actuation tool that is formed monolithically with said cap.

9. The bottle of claim 7, wherein said third weakened regions are formed between said actuation tools of the caps of bottles that are arranged mutually adjacent in series.

10. The bottle of claim 8, wherein said actuation tool is constituted by a pair of actuation tabs, which are mutually diametrically opposite and protrude from the outer lateral surface of said cap.

11. The bottle of claim 8, wherein said actuation tool is constituted by a band that is wrapped substantially like a ring around said cap and is rigidly coupled thereto.

12. The bottle of claim 9, wherein said closure element is constituted by a plug, which is associated, along fourth weakened regions, with the perimetric rim of said dispensing mouth, and said removal element is constituted by a complementary receptacle for containing said plug, which is formed at the top of said cap, means for mutually coupling said plug and said containment receptacle being provided.

13. The bottle of claim 12, wherein said coupling means comprise a ring that protrudes from the outer lateral surface of said plug and a corresponding annular groove that is formed at said containment receptacle, said coupling means being adapted to prevent axial sliding between said plug and said containment receptacle, which are engaged in each other.

14. The bottle of claim 12, wherein said coupling means comprise a plurality of knurlings, which are formed longitudinally on the outer lateral surface of said plug and are adapted to mate with corresponding knurlings formed longitudinally on the inner lateral surface of said containment receptacle, said coupling means being adapted to prevent relative rotation between said plug and said containment receptacle, which are engaged in each other.

15. The bottle of claim 1, wherein said closure element is constituted by a tearable membrane, which is rigidly coupled to the perimetric rim of said dispensing mouth, and said removal element is constituted by a piercing member that protrudes from the top of said cap inside it.

16. The bottle of claim 1, comprising means for fixing said cap to said containment body.

17. The bottle of claim 16, wherein said fixing means are of the threaded type and comprise a screw formed on the outer lateral surface of said containment body and a corresponding female thread formed on the inner lateral surface of said cap.

18. The bottle of claim 1, wherein said dispensing mouth is frustum-shaped and diverges from the inside toward the outside of said containment body.

19. The bottle of claim 12, wherein at least one among said first, second, third and fourth weakened regions is constituted by prescoring lines, tearable bridges, or reduced transverse cross-sections.

20. The bottle of claim 1, comprising an opening for introducing said product, which is formed at the end of said containment body that lies opposite said end, and means for closing said opening once filling has occurred.

21. The bottle of claim 1, wherein said closure means are of the type of a weld of lips of said opening.

* * * * *